US008319409B2

(12) United States Patent
Kameda

(10) Patent No.: US 8,319,409 B2
(45) Date of Patent: Nov. 27, 2012

(54) SPARK PLUG WITH GROUND ELECTRODE HAVING WIDENED AND NARROWED WIDTH PORTIONS

(75) Inventor: Hiroyuki Kameda, Aichi-gun (JP)

(73) Assignee: NGK Spark Plug Co., Ltd., Aichi (JP)

( * ) Notice: Subject to any disclaimer, the term of this patent is extended or adjusted under 35 U.S.C. 154(b) by 18 days.

(21) Appl. No.: 13/120,089

(22) PCT Filed: Sep. 15, 2009

(86) PCT No.: PCT/JP2009/066078

§ 371 (c)(1),
(2), (4) Date: Mar. 21, 2011

(87) PCT Pub. No.: WO2010/038611

PCT Pub. Date: Apr. 8, 2010

(65) Prior Publication Data

US 2011/0175514 A1 Jul. 21, 2011

(30) Foreign Application Priority Data

Sep. 30, 2008 (JP) ..... 2008-253955

(51) Int. Cl.

| | |
|---|---|
| ***H01T 13/28*** | (2006.01) |
| ***H01T 13/20*** | (2006.01) |
| ***H01T 21/00*** | (2006.01) |
| ***H01T 21/02*** | (2006.01) |

(52) U.S. Cl. ..... 313/141; 313/143

(58) Field of Classification Search ..... 313/118–143; 445/7

See application file for complete search history.

(56) References Cited

U.S. PATENT DOCUMENTS

| | | | |
|---|---|---|---|
| 6,166,480 | A | 12/2000 | Ishida et al. |
| 6,707,237 | B2 | 3/2004 | Teramura et al. |

FOREIGN PATENT DOCUMENTS

| | | | |
|---|---|---|---|
| JP | 53-005629 | U | 1/1978 |
| JP | 07-135066 | A | 5/1995 |
| JP | 09-129356 | A | 5/1997 |
| JP | 11-054240 | A | 2/1999 |
| JP | 2000-252039 | A | 9/2000 |
| JP | 2001-307858 | A | 11/2001 |
| JP | 3461637 | B2 | 10/2003 |
| JP | 2004-087464 | A | 3/2004 |
| JP | 2006-236906 | A | 9/2006 |
| JP | 2007-250344 | A | 9/2007 |

*Primary Examiner* — Jospeh L Williams

(74) *Attorney, Agent, or Firm* — Sughrue Mion, PLLC

(57) ABSTRACT

A spark plug (1) including a center electrode (5), an insulator (2), a metal shell (3), and a ground electrode (27). Spark discharge is provided substantially along a direction of an axis (CL1) in a spark discharge gap (33). The ground electrode includes a narrowed width portion (42) having a substantially uniform width smaller than an outer diameter of a tip end surface (5F) of the center electrode, and a widened width portion (41) having a width larger than the width of the narrowed width portion. When viewed from a tip end side, a base end of the narrowed width portion is offset from the tip end surface of the center electrode toward the root side of the ground electrode. The base end of the narrowed width portion is offset from a center of the spark discharge gap toward the tip end side of the spark plug.

5 Claims, 10 Drawing Sheets

SPARK PLUG WITH GROUND ELECTRODE HAVING WIDENED AND NARROWED WIDTH PORTIONS

CROSS REFERENCE TO RELATED APPLICATIONS

This application is a National Stage of International Application No. PCT/JP2009/066078, filed on Sep. 15, 2009, which claims priority from Japanese Patent Application No. 2008-253955, filed on Sep. 30, 2008, the contents of all of which are incorporated herein by reference in their entirety.

TECHNICAL FIELD

The present invention relates to a spark plug for an internal combustion engine.

BACKGROUND ART

A spark plug for use in an internal combustion engine such as an automobile engine includes a center electrode extending, for instance, in an axial direction thereof, an insulator disposed on an outside of the center electrode, a generally tubular metal shell disposed on an outside of the insulator, and a ground electrode having a base end portion that is connected to a tip end portion of the metal shell. The ground electrode is arranged in such a bent-back state that a tip end portion thereof is opposed to a tip end portion of the center electrode. With this arrangement of the ground electrode, a spark discharge gap is generated between the tip end portion of the center electrode and the tip end portion of the ground electrode. Further, there is known a spark plug of a conventional art in which a noble metal chip having a relatively small volume is provided on a portion of the ground electrode defining the spark discharge gap. With the provision of the noble metal chip, the spark plug of the conventional art aims to prevent the ground electrode from taking heat of a flame kernel (that is, quenching phenomenon) and thereby improve the ignition property.

In recent years, with increase in material cost for the noble metal chip which is caused due to lack of resource, there is an increasing demand for such a spark plug constituted without using the noble metal chip in the ground electrode. For this reason, in view of improving the ignition property even when the noble metal chip is not used in the ground electrode, there has been proposed a spark plug in which a portion of the ground electrode which is to be opposed to the center electrode is formed into such a trapezoidal shape in section as to project toward the tip end of the ground electrode, and opposed side faces of the tip end portion of the ground electrode are tapered toward the side of the tip end of the ground electrode (for instance, see Patent Literature 1). According to this conventional art, the quenching phenomenon can be suppressed so that increase in ignition property can be expected.

However, in the spark plug of the above-described conventional art, the ground electrode is not formed into the tapered shape except for the tip end portion thereof, that is, the ground electrode has a relatively large width at the bent portion and the root side portion. Therefore, in the case of the spark plug of the above-described conventional art, an abnormal spark discharge will readily occur between the tip end portion of the center electrode and the bent portion of the ground electrode similar to the ground electrode which is configured to have a substantially uniform width. This will fail to sufficiently attain the effect of improving the ignition property.

In order to solve the above problem, there has been proposed a spark plug including a ground electrode with a tip end portion which is tilted toward the side of a tip end surface of the center electrode such that a corner of the tip end of the ground electrode is opposed to the tip end surface of the center electrode (for instance, see Patent Literature 2). With this construction, occurrence of a spark discharge (i.e., a spark discharge at a normal position) between the corner of the tip end of the ground electrode and the center electrode can be facilitated to thereby increase the ignition property.

However, in a case where the spark plug of the above conventional art is used, increase in ignition property of the spark plug can be attained but local wastage of a portion of the center electrode which is opposed to the corner of the tip end of the ground electrode tends to proceed. As a result, rapid expansion of the spark discharge gap is caused, and therefore, failure to provide a normal spark discharge will occur at an early stage of the usage.

On the other hand, there has been proposed a spark plug including the ground electrode which has a curved face on at least a side opposed to the center electrode (for instance, see Patent Literature 3). With this construction, an air-fuel mixture can be readily flowed into the spark discharge gap to thereby increase the ignition property without deterioration in life of the spark plug.

Citation List

Patent Literatures

Patent Literature 1: Japanese Patent No. 3461637

Patent Literature 2: Japanese Patent Application Unexamined Publication No. 2004-87464

Patent Literature 3: Japanese Patent Application Unexamined Publication No. 2007-250344

SUMMARY OF INVENTION

However, it is necessary to reduce a width of the ground electrode to a certain extent (for instance, reduce a diameter thereof) in order to facilitate introduction of the air-fuel mixture into the spark discharge gap. The reduction in width of the ground electrode results in lowering the strength of the ground electrode. In particular, the bent portion of the ground electrode tends to undergo stress concentration occurring due to vibration which is generated during an operation of an internal combustion engine, or the like. As a result, the bent portion of the ground electrode will suffer from problems such as breakage and damage.

The present invention has been made in view of the above problems. It is an object of the present invention to provide a spark plug for an internal combustion engine which is constructed without using a noble metal chip on a ground electrode and is capable of increasing ignition property, and at the same time, realizing increase in life and ensuring sufficiently high strength of the ground electrode.

In the followings, the spark plug of the present invention will be explained hereinafter with respect to its respective constructions suitable for achieving the above object. In addition, specific functions and effects according to the respective constructions may be described as necessary.

Construction 1: In one aspect of the present invention, there is provided a spark plug for an internal combustion engine, including:

a rod-shaped center electrode that extends in an axial direction of the spark plug;

a tubular insulator having an axial hole that extends in the axial direction of the spark plug in which the center electrode is received;

a tubular metal shell disposed along an outer circumference of the insulator; and a ground electrode which extends from a tip end portion of the metal shell and is disposed in such a bent state that a tip end portion thereof is opposed to said center electrode;

wherein a tip end portion of the center electrode and the tip end portion of the ground electrode cooperate to define a gap therebetween in which spark discharge is provided along the axial direction of the spark plug, wherein the ground electrode is formed with a narrowed width portion at the tip end portion thereof which has a substantially uniform width smaller than an outer diameter of a tip end surface of the center electrode, and a widened width portion which extends between a base end portion of the ground electrode and the narrowed width portion and has a width larger than the width of the narrowed width portion, wherein the narrowed width portion has a base end that is located offset from the tip end surface of the center electrode toward a root side of the ground electrode when viewed from a tip end side of the spark plug in the axial direction of the spark plug, and wherein the base end of the narrowed width portion is located offset from a center of the gap toward the tip end side of the spark plug in the axial direction of the spark plug.

According to the above-described Construction 1, the tip end portion of the ground electrode is formed into the narrowed width portion having the width smaller than that of the base end portion side. With this construction, it is possible to prevent the ground electrode from taking heat of a flame kernel that is generated by the spark discharge and prevent the ground electrode from inhibiting growth (diffusion) of the flame kernel. As a result, the flame diffusion can be increased to thereby realize excellent ignition property.

Further, in a case where spark discharge is provided between a central portion of the ground electrode in the width direction thereof and the center electrode, a flame kernel will be produced in a position where the flame kernel is covered with the ground electrode, so that diffusion of the flame kernel tends to be suppressed by the ground electrode. In contrast, according to Construction 1, the width of the narrowed width portion is set to be smaller than an outer diameter of the tip end surface of the center electrode. Since field strength is relatively high at an edge portion of the center electrode and an edge portion of the ground electrode, spark discharge will readily occur therebetween. With Construction 1, spark discharge can be readily generated between a tip end edge of the center electrode and edges (side edges) of the narrowed width portion which are formed on the side of the center electrode. That is, spark discharge can be readily generated in a position where the center electrode is not covered with the ground electrode. Owing to the thus provided spark discharge and the tip end portion of the ground electrode having the narrowed width, it is possible to effectively suppress inhibition of the growth of the flame kernel which is caused by the ground electrode, thereby enhancing ignition property of the spark plug.

In addition, in a case where the width of the narrowed width portion of the ground electrode is set to be larger than the outer diameter of the tip end surface of the center electrode, a distance between respective parts of a tip end edge of the center electrode and the side edges of the narrowed width portion relatively largely varies depending on the respective parts of the tip end edge of the center electrode. As a result, spark discharge may be concentrated on the parts of the tip end edge of the center electrode which are spaced by a relatively small distance apart from the side edges of the narrowed width portion of the ground electrode. In contrast, according to Construction 1, since the width of the narrowed width portion of the ground electrode is smaller than the outer diameter of the tip end surface of the center electrode, it is possible to prevent occurrence of a large difference in the distance between the respective parts of the tip end edge of the center electrode and the side edges of the narrowed width portion. As a result, the respective parts of the tip end edge of the center electrode can be substantially uniformly worn out so that the life of the center electrode can be prolonged.

Further, the narrowed width portion of the ground electrode is formed such that the base end is located offset from a center of the above-described gap toward the tip end side of the spark plug in the axial direction of the spark plug. In other words, at least a portion of the ground electrode which is located offset from the center of the above-described gap toward a rear end side of the spark plug in the axial direction of the spark plug is formed into a widened width portion. With the arrangement of the narrowed width portion, the bent portion of the ground electrode is formed so as to have a relatively large width, thereby ensuring a sufficiently high strength of the ground electrode.

In the meanwhile, there has been proposed a technology in which a tip end portion of a ground electrode is formed with a narrowed width portion having a substantially uniform width as shown in FIG. 5A of Japanese Patent Application Unexamined Publication No. 2001-307858. However, in this conventional art, the width of the narrowed width portion is larger than an outer diameter of a tip end surface of a center electrode. This will tend to allow the ground electrode to inhibit growth of a flame kernel. In contrast, according to the Construction 1, the width of the narrowed width portion is smaller than the outer diameter of the tip end surface of the center electrode as described above. Therefore, the present invention can serve for remarkably increasing the ignition property.

Construction 2: According to this construction, there is provided the spark plug for an internal combustion engine as described in the above-described Construction 1, in which the narrowed width portion includes side edges formed between a surface opposed to the center electrode and side surfaces disposed adjacent to the opposed surface, and the center electrode includes inner edges each being a part of a tip end edge formed between the tip end surface of the center electrode and an outer circumferential surface of the center electrode, the inner edges each being disposed between the side edges of the narrowed width portion when viewed from the tip end side of the spark plug in the axial direction of the spark plug, wherein a maximum distance F extending between the side edges of the narrowed width portion and the inner edges of the center electrode along a direction perpendicular to a center axis of the narrowed width portion and a distance G of the gap extending along the axial direction of the spark plug satisfy a relation expressed by the formula:

$$F \leqq 1.25G.$$

According to the above-described Construction 2, the spark plug is constructed such that the distance between the side edges of the narrowed width portion and the inner edges of the center electrode is relatively small, that is, the width of the narrowed width portion is sufficiently small. With this construction, it is possible to more certainly prevent the ground electrode from inhibiting growth of the flame kernel and thereby further enhance the ignition property of the spark plug.

Further, in a case where the distance between the inner edges of the center electrode and the side edges of the narrowed width portion is relatively large, spark discharge will tend to occur at a part of the narrowed width portion which is spaced by a relatively small distance apart from the inner edges of the center electrode, that is, at a central part of the opposed surface of the narrowed width portion facing the tip end surface of the center electrode (i.e., a part that is located at the center of the opposed surface of the narrowed width portion when viewed from the side of a tip end surface of the ground electrode), or in the vicinity of the central part of the opposed surface of the narrowed width portion. This will cause inhibition of growth of the flame kernel by the ground electrode, thereby resulting in failure to sufficiently enhance the ignition property. In contrast, according to the Construction 2, spark discharge can be positively provided between the inner edges of the center electrode and the side edges of the narrowed width portion. As a result, it is possible to perform the function and the effect as described above and further enhance the ignition property.

Construction 3: According to this construction, there is provided the spark plug for an internal combustion engine as described in the above Construction 1 or Construction 2, in which the narrowed width portion includes side edges formed between a surface opposed to the center electrode and side surfaces disposed adjacent to the opposed surface, and the center electrode includes inner edges each being a part of a tip end edge formed between the tip end surface of the center electrode and an outer circumferential surface of the center electrode, the inner edges being disposed between the side edges of the narrowed width portion when viewed from the tip end side of the spark plug in the axial direction of the spark plug, and outer edges which are remainders of the tip end edge except for the inner edges, wherein a maximum distance F extending between the side edges of the narrowed width portion and the inner edges of the center electrode along a direction perpendicular to a center axis of the narrowed width portion and a maximum distance H extending between the side edges of the narrowed width portion and the outer edges of the center electrode along a direction perpendicular to the center axis of the narrowed width portion satisfy a relation expressed by the formula:

$$0\ \text{mm} \leqq F-H \leqq 0.3\ \text{mm}.$$

According to the above-described Construction 3, since the relation of 0 mm≦F−H is satisfied, when viewed from the side of the tip end surface of the ground electrode, each of the side edges of the narrowed width portion is opposed to a part of each of the outer edges of the center electrode which is located offset from a middle of the distance between the center of the tip end surface of the center electrode and a most distant part of each of the outer edges which is located most distant from the center of the tip end surface of the center electrode, toward an outer circumferential side of each of the outer edges. That is, the narrowed width portion of the ground electrode is configured to have a sufficiently large width. With this construction, it is possible to ensure a sufficient strength of the narrowed width portion of the ground electrode and suppress a considerable reduction of the distance between the inner edges of the center electrode and the side edges of the narrowed width portion of the ground electrode. On the other hand, by satisfying the relation of F−H≦0.3 mm, it is possible to suppress considerable reduction of the distance between the outer edges of the center electrode and the side edges of the narrowed width portion of the ground electrode. That is, by satisfying the relation of 0 mm≦F−H≦0.3 mm, it is possible not only to ensure a sufficiently high strength of the narrowed width portion of the ground electrode but also to more certainly suppress occurrence of a large difference between the respective parts of the tip end edge of the center electrode and the side edges of the narrowed width portion, so that more uniform wear of the center electrode can be achieved. As a result, the durability of the spark plug can be further enhanced and then the life thereof can be further prolonged. Construction 4: According to this construction, there is provided the spark plug for an internal combustion engine as described in any one of the above Constructions 1 to 3, in which a distance D extending between a part of the tip end surface of the center electrode which is disposed closest to the root of the ground electrode and the base end of the narrowed width portion along the center axis of the narrowed width portion satisfies the formula:

$$D \geqq 0.3\ \text{mm}.$$

According to the above-described Construction 4, the minimum distance D between the base end of the narrowed width portion and the tip end surface of the center electrode along the center axis of the narrowed width portion is set to 0.3 mm or more. That is, the widened width portion of the ground electrode which may inhibit growth of the flame kernel is located in the position more distant from a position where generation of the flame kernel is expected. With this construction, it is possible to more certainly suppress inhibition of growth of the flame kernel and thereby further enhance the ignition property.

In the meanwhile, an upper limit of the distance D may be set so as to satisfy the condition that the base end of the narrowed width portion is located offset from the center of the spark discharge gap toward the tip end side of the spark plug in the axial direction of the spark plug.

Construction 5: According to this construction, there is provided the spark plug for an internal combustion engine as described in any one of the above Constructions 1 to 4, in which assuming that a direction extending to be close to the root side of the ground electrode is expressed by a minus "−" direction and a direction extending to be away from the root side of the ground electrode is expressed by a plus "+" direction, when being viewed from the tip end side of the spark plug in the axial direction of the spark plug and using a part of the tip end surface of the center electrode which is disposed most distant from the root of the ground electrode, as a reference, a distance E extending between the part of the tip end surface of the center electrode which is disposed most distant from the root of the ground electrode and a tip end of the narrowed width portion along the center axis of the narrowed width portion satisfies the formula:

$$-0.4\ \text{mm} \leqq E \leqq +0.5\ \text{mm}.$$

According to the above-described Construction 5, even in a case where the tip end of the narrowed width portion of the ground electrode is constructed to project beyond the part of the tip end surface of the center electrode which is disposed most distant from the root of the ground electrode when viewed from the tip end side of the spark plug in the axial direction thereof, an amount of the projection of the tip end of the narrowed width portion along the center axis of the narrowed width portion is set to 0.5 mm or less. With this construction, inhibition of diffusion of the flame kernel by the ground electrode can be more certainly suppressed, whereby further increase in ignition property can be achieved. On the other hand, in a case where the tip end of the narrowed width portion of the ground electrode is constructed to retract from the part of the tip end surface of the center electrode which is disposed most distant from the root of the ground electrode when viewed from the tip end side of the spark plug in the axial direction of the spark plug, an amount of the retraction of the tip end of the narrowed width portion along the center axis of the narrowed width portion is set to 0.4 mm or less. With this construction, it is possible to provide spark discharge between the tip end portion of the ground electrode (the narrowed width portion) and the part of the tip end surface of the center electrode which is disposed most apart from the root of the ground electrode, and then allow more uniform wear of the center electrode. That is, the ignition property and the durability of the spark plug can be further enhanced by controlling the distance E to lie within the range of $-0.4\ \text{mm} \leqq E \leqq 0.5\ \text{mm}$.

DESCRIPTION OF EMBODIMENTS

Figure 1:
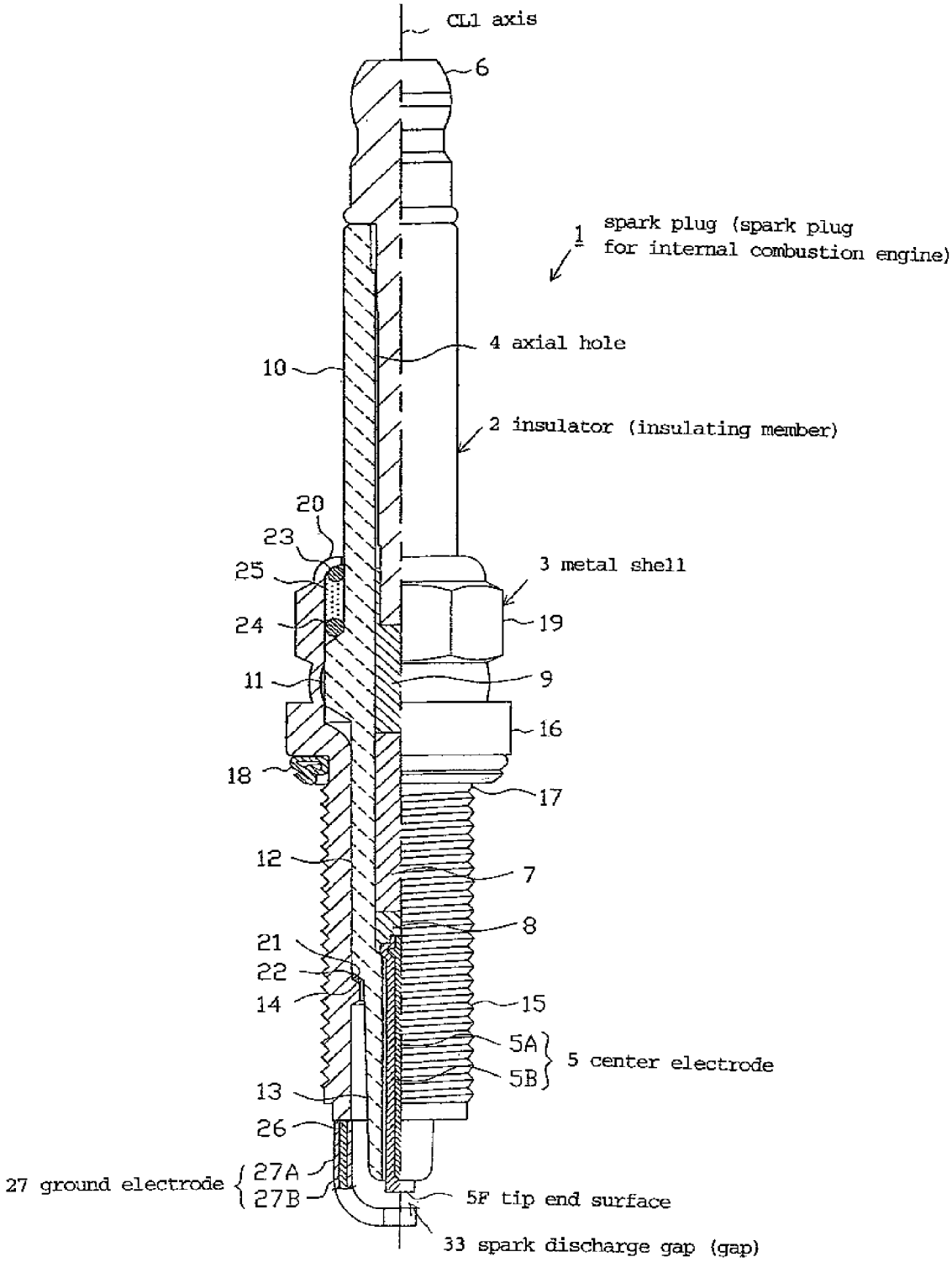
FIG. 1 is a partly fragmentary front view of a spark plug according to embodiments of the present invention.

In the following, an embodiment of the present invention is explained by referring to the accompanying drawings. FIG. 1 is a partly fragmentary sectional view of a spark plug 1 for an internal combustion engine (hereinafter referred to merely as "spark plug"). In FIG. 1 and like drawings, an upward and downward direction denotes a direction of an axis CL1 of the spark plug 1 and a lower side denotes a tip end side (or a front end side) of the spark plug 1 and an upper side denotes a rear end side of the spark plug 1.

The spark plug 1 is constituted of a tubular insulator 2 as an insulating member, and a tubular metal shell 3 retaining the insulator.

The insulator 2 is formed by baking alumina or the like as well known and configured to include a rear end side body portion 10 formed on the rear end side of the spark plug 1, a large diameter portion 11 which is formed on the side closer to the tip end side of the spark plug 1 than the rear end side body portion 10 and projects radially outwardly therefrom, and an intermediate body portion 12 which is formed on the side closer to the tip end side of the spark plug 1 than the large diameter portion 11 and has a diameter smaller than that of the large diameter portion 11, and an elongated leg portion 13 which is formed on the side closer to the tip end side of the spark plug 1 than the intermediate body portion 12 and has a diameter smaller than that of the intermediate body portion 12. The large diameter portion 11, the intermediate body portion and the substantially entire portion of the elongated leg portion 13 are accommodated within the metal shell 3. A tapered stepped portion 14 is formed on a connecting portion between the elongated leg portion 13 and the intermediate body portion 12. The insulator 2 is engaged with the metallic insulator 3 at the stepped portion 14.

Further, the insulator 2 is formed with an axial hole 4 which extends through the insulator 2 along the axis CL1. A center electrode 5 is inserted into a tip end side of the axial hole 4 and fixed thereto. The center electrode 5 is formed into a rod shape (a cylindrical shape) as a whole and has a flat tip end surface 5F which projects from a tip end of the insulator 2. Further, the center electrode 5 includes an inner layer 5A made of copper or a copper alloy and an outer layer 5B made of a nickel (Ni) alloy containing Ni as a main component. In this embodiment, an outer diameter of the center electrode 5 is set to 1.3 mm or more.

Further, a terminal electrode 6 is inserted into a rear end side of the axial hole 4 and fixed thereto in a state projecting from a rear end of the insulator 2.

Further, a cylindrical resistor 7 is disposed between the center electrode 5 and the terminal electrode 6 in the axial hole 4. The resistor 7 has opposite end portions which are electrically connected with the center electrode 5 and the terminal electrode 6 through glass seal layers 8, 9, respectively.

In addition, the metal shell 3 is made of a metal such as a low-carbon steel and formed into a tubular shape. The metal shell 3 includes a screw portion (a male screw portion) 15 which is formed on an outer circumferential surface of the metal shell 3 and serves for mounting the spark plug 1 to an engine head (not shown) of the internal combustion engine. A seat portion 16 is formed on an outer circumferential surface of the metal shell 3 on the side of a rear end of the screw portion 15. A ring-shaped gasket 18 is fitted to a screw neck 17 which is disposed at a rear end of the screw portion 15. The metal shell 3 further includes a tool engagement portion 19 on the rear end side thereof which has a hexagonal shape in section suitable for engagement with the tool such as a wrench upon mounting the metal shell 3 to the engine head, and a caulking portion 20 which is formed on the side of a rear end of the tool engagement portion 19 and serves for holding the insulator 2 to the metal shell 3.

Further, the metal shell 3 has a tapered stepped portion 21 on an inner circumferential surface thereof which serves for engaging the insulator 2. The insulator 2 is inserted into the metal shell 3 from the rear end side of the metal shell 3 toward the tip end side thereof and fixed to the metal shell 3 by caulking an opening portion of the metal shell 3 disposed on the rear end side, in a radially inward direction thereof in such a state that the stepped portion 14 of the insulator 2 is engaged with the stepped portion 21 of the metal shell 3. That is, with the formation of the caulking portion 20, the insulator 2 is fixed to the metal shell 3. Further, an annular plate-shaped packing 22 is disposed between the stepped portion 14 of the insulator 2 and the stepped portion 21 of the metal shell 3. With the provision of the packing 22, the combustion chamber can be kept in a hermetically sealed condition and an air-fuel mixture entering into a clearance between the elongated leg portion 13 of the insulator 2 exposed to an inside of the combustion chamber and the inner circumferential surface of the metal shell 3 can be prevented from leaking to the outside.

In addition, in order to further enhance the hermetic seal provided by the caulking, annular ring members 23, 24 are disposed between the metal shell 3 and the insulator 2 on the rear end side of the metal shell 3, and a talc powder 25 is filled between the ring members 23, 24. That is, the metal shell 3 holds the insulator 2 through the plate-shaped packing 22, the ring members 23, 24 and the talc powder 25.

Further, a ground electrode 27 made of a Ni alloy and the like is connected to a tip end surface of a tip end portion 26 of the metal shell 3. The ground electrode 27 has a double layer structure constituted of an outer layer 27A and an inner layer 27B. More specifically, the outer layer 27A is made of the Ni alloy [for instance, INCONEL alloy 600 or INCONEL alloy 601 (both are registered trademarks)]. On the other hand, the inner layer 27B is made of a copper alloy or pure copper which has a thermal and electric conductivity higher than that of the Ni alloy. The ground electrode 27 is bent back such that a surface of a tip end portion of the ground electrode 27 which is located on the side of the center electrode 5 is opposed to the tip end surface 5F of the center electrode 5. With this construction, a spark discharge gap 33 is defined between the tip end surface 5F of the center electrode 5 and the surface of the ground electrode 27 located on the side of the center electrode 5, and spark discharge is provided substantially along the axis CL1.

Figure 2A:
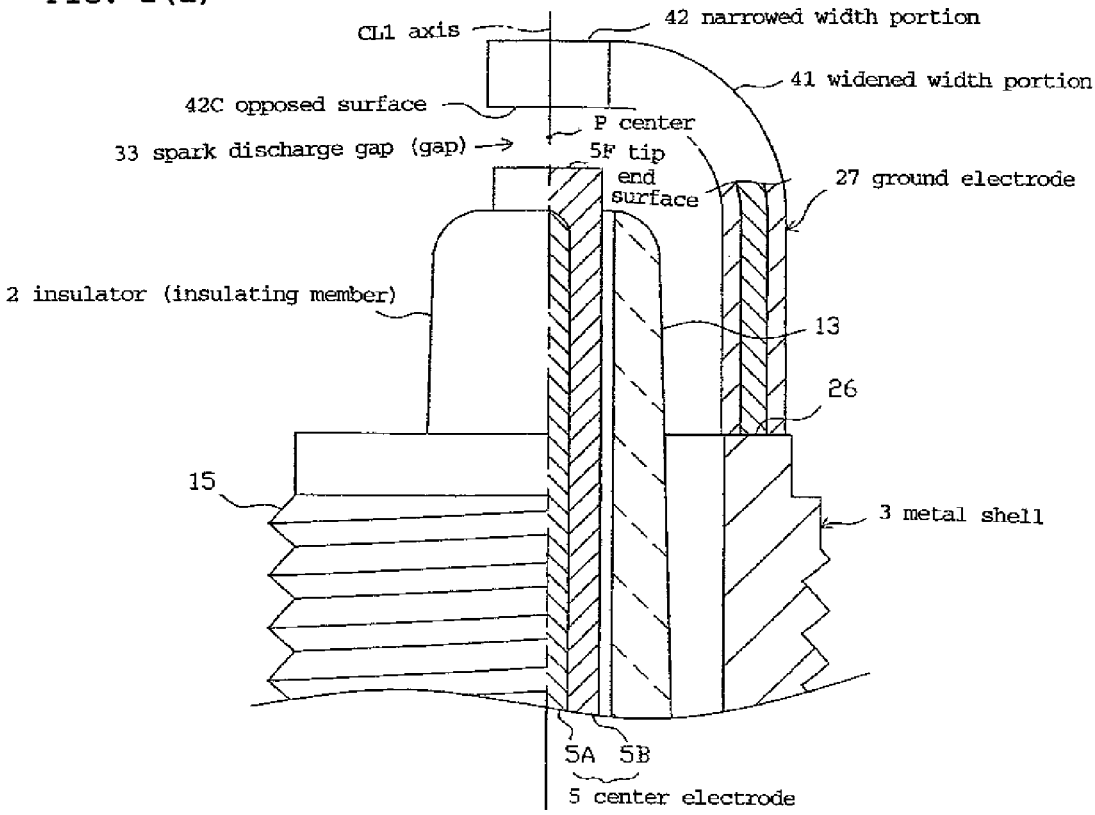
FIG. 2(*a*) is a partly fragmentary front view of a tip end portion of the spark plug, and FIG. 2(*b*) is a partly enlarged front view for explanation of a positional relation between a center electrode and a narrowed width portion of a ground electrode of the spark plug.
Figure 2B:
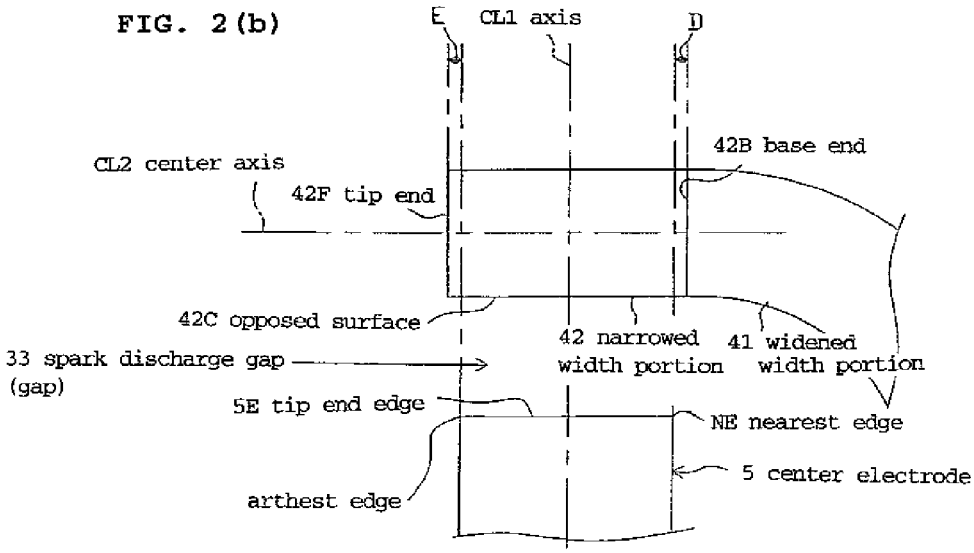
Figure 3A:
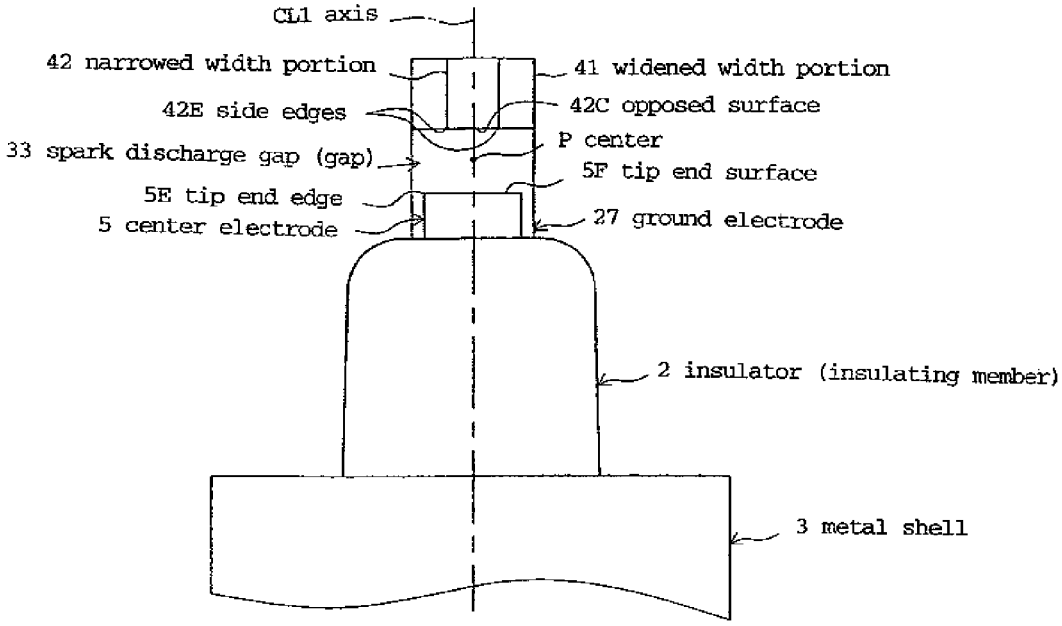
FIG. 3(*a*) is an enlarged side view of the tip end portion of the spark plug, and FIG. 3(*b*) is a partly enlarged side view for explanation of a positional relation between the center electrode and the narrowed width portion of the ground electrode of the spark plug.
Figure 3B:
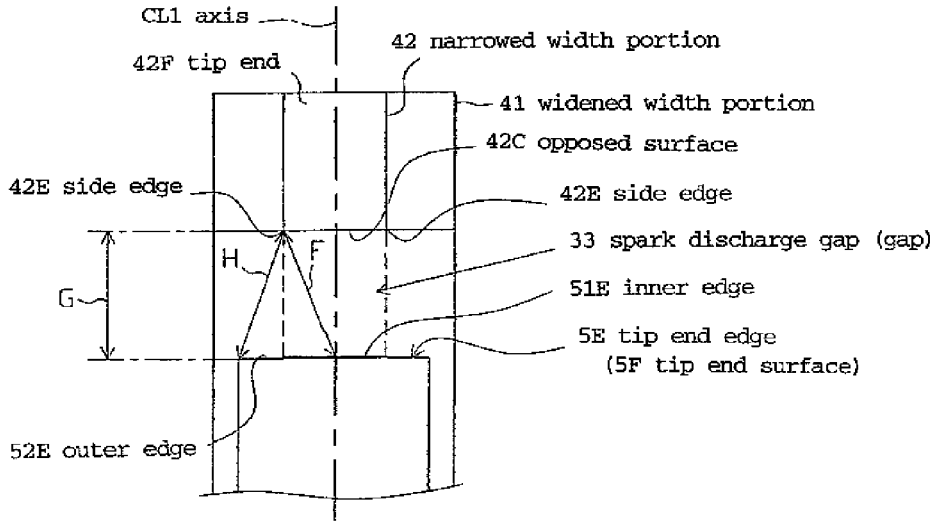
Figure 4A:
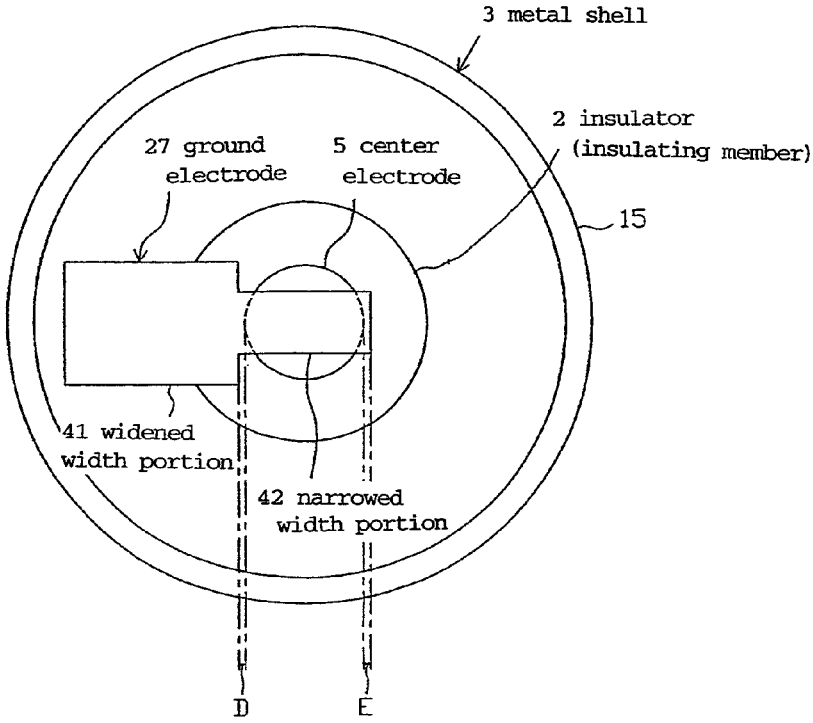
FIG. 4(*a*) is an enlarged plan view of the tip end portion of the spark plug, and FIG. 4(*b*) is a partly enlarged plan view for explanation of a positional relation between the center electrode and the narrowed width portion of the ground electrode of the spark plug.
Figure 4B:
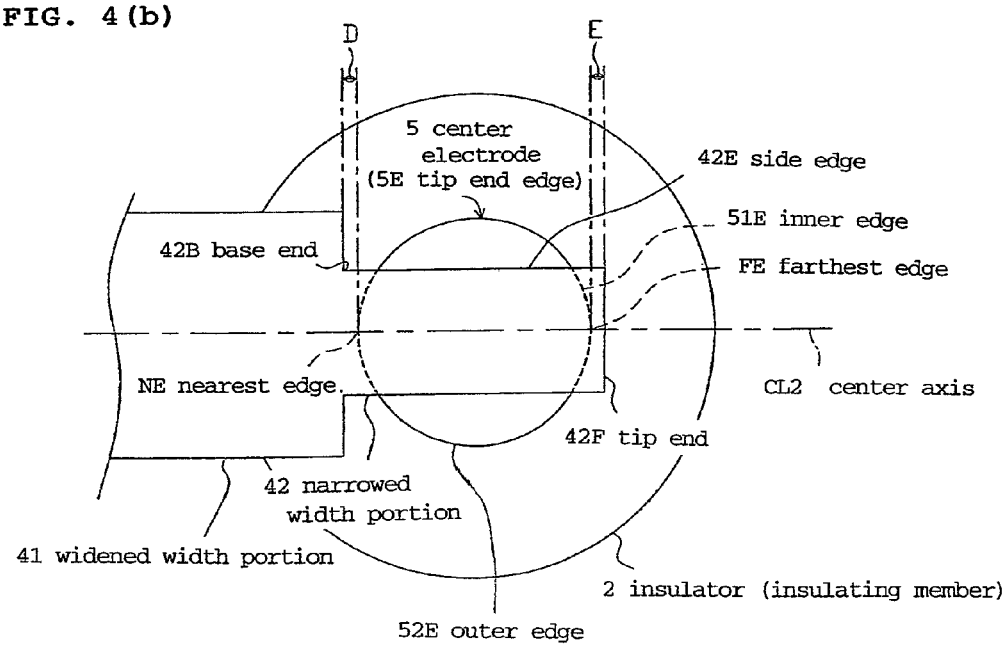

Further, in this embodiment, as shown in FIG. 2(*a*), FIG. 3(*a*) and FIG. 4(*a*), the ground electrode 27 includes a widened width portion 41 having a width larger than an outer diameter of the tip end surface 5F of the center electrode 5, and a narrowed width portion 42 having a width smaller than the outer diameter of the tip end surface 5F of the center electrode 5. The widened width portion 41 extends from the tip end portion of the metal shell 3 to a position above and before the center electrode 5. The narrowed width portion 42 extends from a tip end of the widened width portion 41 and covers at least a central area of the tip end surface 5F of the center electrode 5. The narrowed width portion 42 has a base end 42B which is located offset from the center P of the spark discharge gap 33 toward the tip end side of the spark plug 1 in the direction of the axis CL1.

Further, in this embodiment, as shown in FIG. 3(*b*) and FIG. 4(*b*), the narrowed width portion 42 includes side edges 42E formed between a surface 42C opposed to the tip end surface 5F of the center electrode 5 and side surfaces disposed adjacent to the opposed surface 42C. The center electrode 5 includes inner edges 51E each being a part of an annular tip end edge 5E formed between the end surface 5F of the center electrode 5 and an outer circumferential surface of the center electrode 5. The inner edges 51E are disposed between the side edges 42E of the narrowed width portion 42 when viewed from the tip end side of the spark plug in the direction of the axis CL1. Here, a maximum distance (referred to hereby as "an inner edge distance") F extending between the side edges 42E of the narrowed width portion 42 and the inner edges 51E of the center electrode 5 along a direction perpendicular to a center axis CL2 of the narrowed width portion 42, and a distance (referred to hereby as "a gap distance") G of the spark discharge gap 33 extending along the direction of the axis CL1 satisfy a relation expressed by the formula: $F \leqq 1.25G$. The width of the narrowed width portion 42 and the like are set so as to satisfy the above-described relation.

Further, the center electrode 5 includes outer edges 52E which are remainders of the tip end edge 5E except for the inner edges 51E. Here, a value (F−H) which is obtained by subtracting a maximum distance (referred to hereby as "an outer edge distance") H extending between the side edges 42E of the narrowed width portion 42 and the outer edges 52E of the center electrode 5 along the direction perpendicular to the center axis CL2 of the narrowed width portion 42 from the inner edge distance F is set to lie within the range of 0 mm to 0.3 mm.

In addition, a distance D extending between the base end 42B of the narrowed width portion 42 and a part (the nearest edge) NE of the tip end surface 5F of the center electrode which is disposed closest to the root (the connecting portion) of the ground electrode 27 along the center axis CL2 of the narrowed width portion 42 as shown in FIG. 2(*b*) and FIG. 4(*b*), is set so as to satisfy the formula: $D \geqq 0.3$ mm.

Further, the narrowed width portion 42 is constructed such that when viewed from the tip end side of the spark plug in the direction of the axis CL1, a tip end 42F thereof projects from a part (the farthest edge) FE of the tip end surface 5F of the center electrode 5 which is disposed most distant from the root (the connecting portion) of the ground electrode 27, toward the side distant from the root (the connecting portion) of the ground electrode 27. However, an amount of the projection of the tip end 42F is set to a relatively small value. In this embodiment, assuming that the amount of the projection of the tip end 42F is represented by a distance (referred to as "a tip end distance") E along the center axis CL2 of the of the narrowed width portion 42, the tip end distance E is set so as to satisfy the formula: $E \leqq 0.5$ mm.

In this embodiment, the narrowed width portion 42 is constructed such that when viewed from the tip end side of the spark plug in the direction of the axis CL1, the tip end 42F projects from the farthest edge FE in a direction extending apart from the root (the connecting portion) of the ground electrode 27. However, the narrowed width portion 42 may be constructed such that when viewed from the tip end side of the spark plug in the direction of the axis CL1, the tip end 42F retracts from the farthest edge FE toward the root side of the ground electrode 27. In this case, an amount of the retraction along the center axis CL2 is preferably set to 0.4 mm or less. Accordingly, assuming that a direction extending to be apart from the root side of the ground electrode 27 is expressed by a plus "+" direction and a direction extending to be close to the root side of the ground electrode 27 is expressed by a minus "−" direction, when being viewed from the tip end side of the spark plug 1 in the direction of the center axis CL1 and using the farthest edge FE as a reference point, the tip end distance E is set so as to satisfy the formula: $-0.4 \text{ mm} \leqq E \leqq +0.5$ mm.

As described above, according to this embodiment, the part of the tip end portion of the ground electrode 27 which is opposed to the tip end surface 5F of the center electrode 5 is in the form of as the narrowed width portion 42 having a width smaller than that of the base end portion (the widened width portion 41) of the ground electrode 27. With this construction, it is possible to prevent the ground electrode 27 from taking heat of the flame kernel that is generated by spark discharge and to prevent the ground electrode 27 from inhibiting growth (diffusion) of the flame kernel. As a result, the flame diffusion property of the spark plug can be enhanced, thereby realizing an excellent ignition property.

Further, the width of the narrowed width portion 42 is set to be smaller than the outer diameter of the tip end surface 5F of the center electrode 5. With this construction, spark discharge tends to occur between the tip end edge 5E of the center electrode 5 and the side edges 42E of the narrowed width portion 42. That is, the spark discharge tends to occur in a position where the center electrode 5 is not covered with the ground electrode 27. Owing to this construction in addition to the construction of the tip end portion of the ground electrode 27 which is formed into the narrowed width portion, it is possible to effectively suppress inhibition of growth of the flame kernel by the ground electrode 27 and further enhance the ignition property of the spark plug.

Further, since the width of the narrowed width portion 42 is set to be smaller than the outer diameter of the tip end surface 5F of the center electrode 5, it is possible to suppress occurrence of a large difference in distance between the respective parts of the tip end edge 5E of the center electrode 5 and the side edges 42E of the narrowed width portion 42. As a result, the respective portions of the center electrode 5 can be substantially uniformly worn, thereby prolonging the life of the spark plug.

In addition, the narrowed width portion 42 is configured such that the base end 42B is located offset from the center P of the spark discharge gap 33 toward the tip end side of the spark plug 1 in the direction of the axis CL1. In other words, at least a portion of the ground electrode 27 which is located on the rear end side of the spark plug 1 in the direction of the axis CL1 is configured as the widened width portion 41. Accordingly, the bent portion of the ground electrode 27 is formed so as to have a relatively large width, thereby ensuring a sufficiently high strength of the ground electrode 27.

Further, the relation of $F \leqq 1.25G$ is satisfied, and the distance between the side edges 42E of the narrowed width portion 42 and the inner edges 51E of the center electrode 5 is therefore set to be relatively small, that is, the width of the narrowed width portion 42 is set to be relatively small. With this construction, it is possible to more certainly suppress inhibition of growth of the flame kernel and the like which are caused by the ground electrode 27, thereby further enhancing the ignition property. Furthermore, by setting the distance between the side edges 42E of the narrowed width portion 42 and the inner edges 51E of the center electrode 5 to be relatively small, spark discharge can be positively provided between the inner edges 51E of the center electrode 5 and the side edges 42E of the narrowed width portion 42. As a result, the ignition property of the spark plug can be further enhanced.

On one hand, since the relation of $0\ \text{mm} \leqq F-H$ is satisfied, when viewed from the side of the tip end surface of the ground electrode 27, each of the side edges 42E of the narrowed width portion 42 is opposed to a part of each of the outer edges 52E which is located offset from a middle of the distance between the center of the tip end surface 5F of the center electrode 5 and a most distant part of each of the outer edges which is located most distant from the center of the tip end surface 5F, toward the outer circumferential side of each of the outer edges 52E. That is, the narrowed width portion 42 is configured to have a sufficiently large width. With this construction, it is possible to ensure a sufficiently high strength of the narrowed width portion 42 and suppress a considerable reduction of the distance between the inner edges 51E of the center electrode 5 and the side edges 42E of the narrowed width portion 42. On the other hand, by satisfying the relation of $F-H \leqq 0.3$ mm, it is possible to suppress a considerable reduction of the distance between the outer edges 52E of the center electrode 5 and the side edges 42E of the narrowed width portion 42. That is, by satisfying the relation of $0\ \text{mm} \leqq F-H \leqq 0.3$ mm, it is possible not only to ensure the strength of the narrowed width portion 42 but also more certainly suppress occurrence of a large difference between the respective parts of the tip end edge 5E of the center electrode 5 and the side edges 42E of the narrowed width portion 42, so that more uniform wear of the center electrode 5 can be achieved. As a result, the durability of the spark plug can be further enhanced and then the life thereof can be further prolonged. In addition, in this embodiment, a minimum distance D extending from the base end 42B of the narrowed width portion 42 to the tip end surface 5F of the center electrode 5 along the center axis CL2 of the narrowed width portion 42 is set to 0.3 mm or more. That is, the widened width portion 41 which may inhibit growth of the flame kernel is located in the position relatively distant from a position where generation of the flame kernel is expected. With this construction, it is possible to more certainly suppress inhibition of growth of the flame kernel and thereby further enhance the ignition property of the spark plug.

Further, the tip end 42F of the narrowed width portion 42 is constructed to project beyond the farthest edge FE of the center electrode 5 when viewed from the tip end side of the spark plug 1 in the direction of the axis CL1. With this construction, it is possible to facilitate generation of the spark discharge between the tip end portion of the narrowed width portion 42 and a portion of the tip end surface 5F of the center electrode 5 which is located apart from the root of the ground electrode 27. Further, more uniform wear of the center electrode 5 can be attained. On the other hand, the amount of the projection of the tip end 42F along the center axis CL2 of the narrowed width portion 42 is set to 0.5 mm or less. With this construction, inhibition of diffusion of the flame kernel by the ground electrode 27 can be more certainly suppressed to thereby further enhance the ignition property of the spark plug.

In addition, the outer diameter of the center electrode 5 is set to be sufficiently large, i.e., 1.3 mm or more. Therefore, by satisfying the relation of $0\ \text{mm} \leqq F-H \leqq 0.3$ mm, it is possible to attain more uniform wear of the center electrode 5 and further enhancement in durability of the spark plug.

Figure 5:
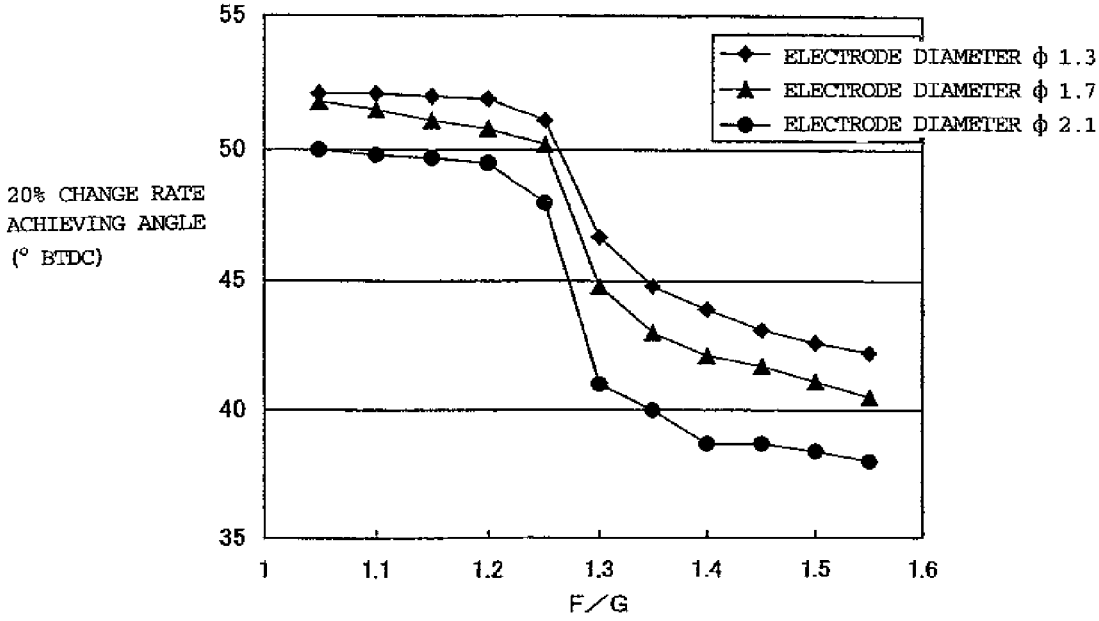
FIG. 5 is a graph showing results of an ignition property evaluation test of a plurality of samples which are different in value obtained by dividing an inner edge distance by a gap distance, from each other.

Next, an ignition property evaluation test was carried out in order to recognize the functions and effects of this embodiment. The ignition property evaluation test was carried out in the following manner. Specifically, a plurality of samples of a spark plug which were different in dimension such as the outer diameter of the center electrode and the inner edge distance from each other, were prepared and installed to a four-cylinder 1.5 L engine. The engine was operated under the conditions that revolution number was 8000 rpm, intake negative pressure was −540 mmHg, and air-fuel ratio of an intake air-fuel mixture was 14.5. An ignition advance angle was gradually advanced, and an ignition angle at the time at which a rate of change in average combustion pressure reached 20% (a 20% change rate achieving angle) was obtained. FIG. 5 shows a graph indicating a relation between the 20% change rate achieving angle and the value (F/G)

obtained by dividing the inner edge distance by the gap distance in each of the samples which were different in outer diameter of the center electrode from each other. In FIG. 5, the 20% change rate achieving angle of each of the samples with a center electrode having an outer diameter of 1.3 mm was plotted by solid black rhombus, and the 20% change rate achieving angle of each of the samples with a center electrode having an outer diameter of 1.7 mm was plotted by solid black triangle, and the 20% change rate achieving angle of each of the samples with a center electrode having an outer diameter of 2.1 mm was plotted by solid black circle. Further, the base end distance and the tip end distance in each of the samples were adjusted to 0.3 mm.

As shown in FIG. 5, it was found that among the samples which were different in outer diameter of the center electrode from each other, the samples in which the value (F/G) obtained by dividing the inner edge distance by the gap distance was 1.25 or less (i.e., the samples in which the relation of $F \leqq 1.25G$ was satisfied) exhibited the remarkably enhanced ignition property. The reason therefor is considered to be that the width of the narrowed width portion was sufficiently reduced by setting the value obtained by dividing the inner edge distance by the gap distance to 1.25 or less, so that inhibition of growth of the flame kernel which would be caused by the ground electrode was effectively suppressed.

Figure 6:
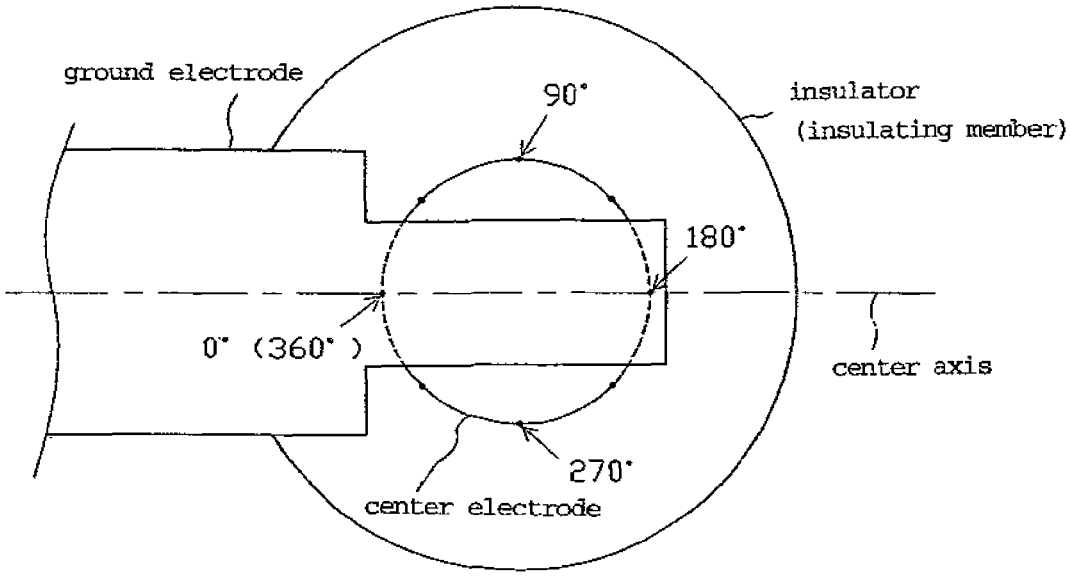
FIG. 6 is a schematic plan view of the tip end portion of the spark plug, for explanation of a position of measurement of an electrode wear amount.
Figure 7:
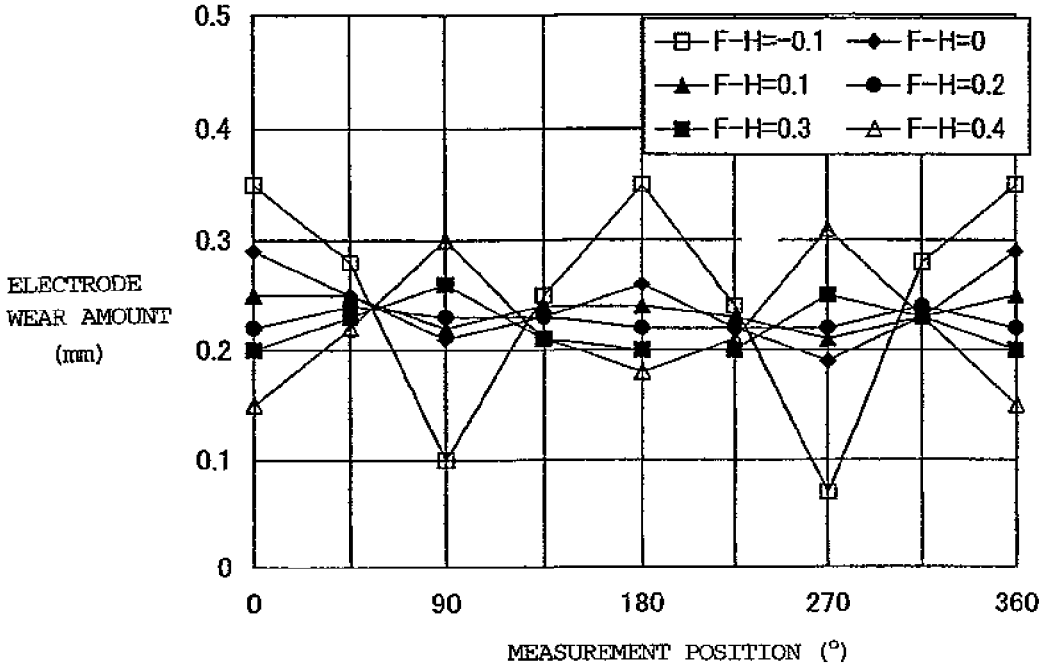
FIG. 7 is a graph showing an electrode wear amount as measured in respective measurement positions of the electrode in a durability evaluation test of a plurality of samples which are different in value obtained by subtracting an outer edge distance from the inner edge distance, from each other.

Next, a plurality of samples of a spark plug which were different in the value (F−H) obtained by subtracting the outer edge distance from the inner edge distance from each other were prepared and subjected to a durability evaluation test. The durability evaluation test was carried out in the following manner. Spark discharge was provided in each of the samples at discharge intervals of 60 Hz (60 times per one minute) over a period of 100 hours. After completion of the discharge, an amount of electrode wear was measured in predetermined measurement positions. The term "predetermined measurement positions" as used herein mean respective positions of parts of the tip end edge of the center electrode which are different in rotating angle by 45° each about the center of the tip end surface of the center electrode from each other assuming that a position of the part of the tip end edge of the center electrode which is located nearest to the root of the ground electrode is an angular position of 0°) (360° as shown in FIG. 6 (as indicated by the solid black circle in FIG. 6). In addition, the electrode wear amount was obtained by measuring a wear amount of the tip end surface of the center electrode of the samples along the axial direction after completion of the test based on the tip end surface of the center electrode of the samples before carrying out the test. FIG. 7 shows a graph indicating the electrode wear amount in the respective measurement positions in the respective samples. Table 1 shows values (wear difference) obtained by subtracting a minimum value of the electrode wear amount in the respective measurement positions from a maximum value thereof in the respective samples. In FIG. 7, blank squares denote the electrode wear amounts in the samples having the value "F−H" of −0.1 mm, solid black rhombuses denote the electrode wear amounts in the samples having the value "F−H" of 0 mm, solid black triangles denote the electrode wear amounts in the samples having the value "F−H" of 0.1 mm, solid black circles denote the electrode wear amounts in the samples having the value "F−H" of 0.2 mm, solid black squares denote the electrode wear amounts in the samples having the value "F−H" of 0.3 mm, and blank triangles denote the electrode wear amounts in the samples having the value "F−H" of 0.4 mm.

TABLE 1

| F-H (mm) | Electrode Wear Difference (mm) |
|---|---|
| −0.1 | 0.28 |
| 0 | 0.1 |
| 0.1 | 0.04 |
| 0.2 | 0.02 |
| 0.3 | 0.06 |
| 0.4 | 0.16 |

As shown in FIG. 7 and Table 1, in the samples having the value "F−H" set in the range of 0 mm to 0.3 mm, the wear difference was 0.1 mm or less and fluctuation in the electrode wear amounts in the respective positions of the respective parts of the tip end edge of the center electrode was extremely small. That is, it was found that localization in electrode wear could be effectively suppressed. The reason therefor is considered to be that spark discharge was generated with a substantially uniform frequency at the respective parts of the tip end edge due to a relatively less fluctuation in the distance between the respective parts of the tip end edge of the center electrode and the side edges of the narrowed width portion.

Figure 8:
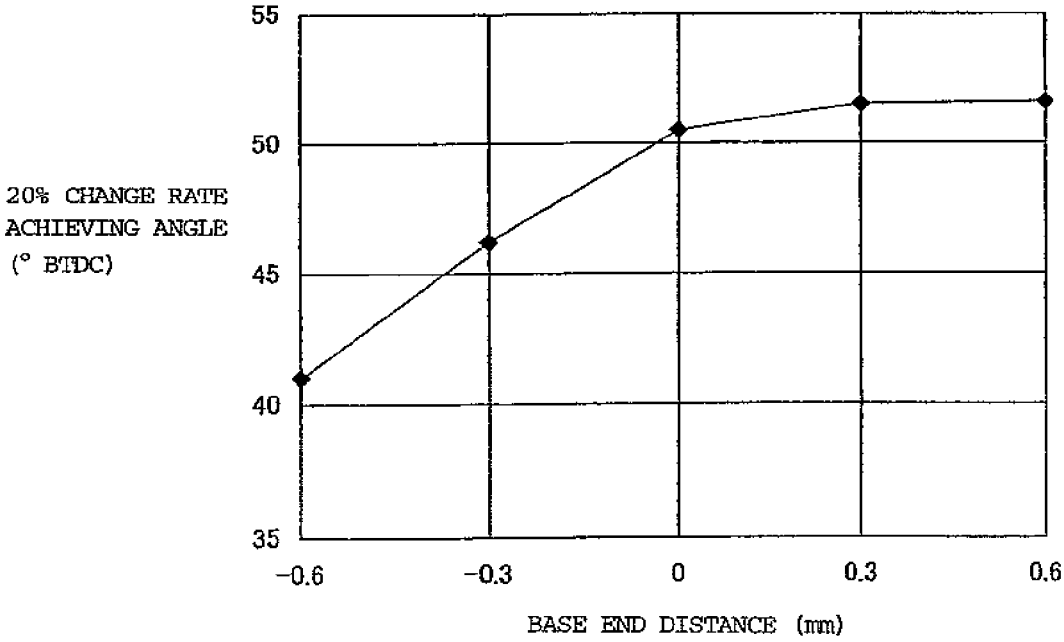
FIG. 8 is a graph showing results of an ignition property evaluation test of samples which are different in value of a base end distance, from each other.

Next, samples of a spark plug which were different in the base end distance from each other were subjected to the above-described ignition property evaluation test. In each of the samples used in the test, the outer diameter of the center electrode was 1.7 mm, the value (F/G) obtained by dividing the inner edge distance by the gap distance was 1.1, and the tip end distance was 0.3 mm. FIG. 8 shows a graph indicating a relation between the base end distance and the 20% change rate achieving angle in the respective samples.

As shown in FIG. 8, in the samples each having a base end distance of 0 mm or more, that is, in the samples formed such that the base end of the narrowed width portion is located offset from the tip end surface of the center electrode toward the root side of the ground electrode when viewed from the tip end side of the spark plug in the axial direction thereof, the 20% change rate achieving angle exceeded 50° BTDC. It was therefore found that these samples had excellent ignition properties. The reason therefor is considered to be that since at least a part of the tip end portion of the ground electrode which is opposed to the tip end surface of the center electrode is formed into the narrowed width portion, the ground electrode is effectively prevented from taking heat of the flame kernel that is generated upon spark discharge as well as from inhibiting growth (diffusion) of the flame kernel.

Further, in the samples each having a base end distance of 0.3 mm or more, the further enhanced ignition properties were exhibited. The reason therefor is considered to be that growth of the flame kernel was further promoted owing to such an arrangement that the widened width portion of the ground electrode which might inhibit the growth of the flame kernel was located in the position more distant from the position where generation of the spark discharge is expected upon normal discharging. From the above-described test results, the base end distance is preferably set to 0.3 mm or more in order to enhance the ignition property. However, from the viewpoint of sufficiently ensuring the strength of the bent portion of the ground electrode, it is necessary that the base end of the narrowed width portion is positioned on the tip end side of the spark plug in the axial direction of the spark plug with respect to the center of the spark discharge gap. Accordingly, it is required that the base end distance is set so as to lie within the range capable of satisfying the above positional condition.

Figure 9:
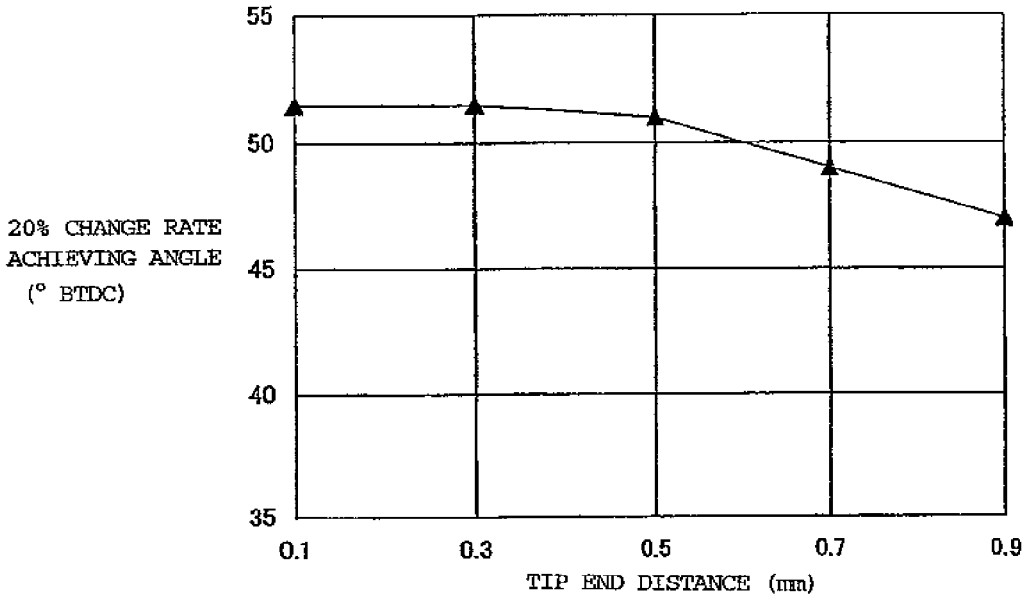
FIG. 9 is a graph showing a result of an ignition property evaluation test of samples which are different in value of a tip end distance, from each other.
Figure 10:
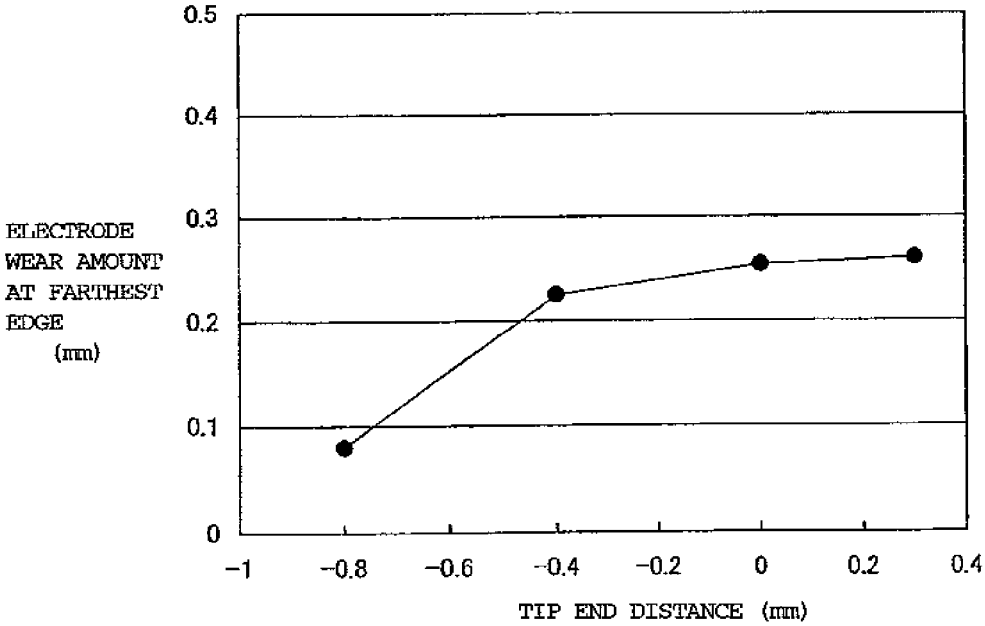
FIG. 10 is a graph showing an electrode wear amount as measured at the farthest edge of the center electrode in a durability evaluation test of samples which are different in value of a tip end distance, from each other.

Next, samples of a spark plug which were different in the tip end distance (that is, the distance which extends from the farthest edge of the center electrode to the tip end of the narrowed width portion along the center axis of the narrowed width portion when viewed from the tip end side of the spark plug in the axial direction of the spark plug, in which the direction extending to be apart from the base end portion of the ground electrode is indicated by a plus "+" direction and the direction extending to be close to the base end portion of the ground electrode is indicated by a minus "−" direction) by variously changing a length of the ground electrode, were prepared and subjected to the ignition property evaluation test and the durability evaluation test as described above. FIG. 9 shows a graph indicating a relation between the tip end distance and the 20% change rate achieving angle in the respective samples, and FIG. 10 shows a graph indicating a relation between the tip end distance and the electrode wear amount at the farthest edge. In each of the samples, the outer diameter of the center electrode was 1.7 mm, the value (F−H) obtained by subtracting the outer edge distance from the inner edge distance was 0 mm, and the rear end distance was 0.3 mm.

It was found that excellent ignition properties can be realized by the samples having a tip end distance of +0.5 mm or less as shown in FIG. 9. The reason therefor is considered to be that by setting the amount of projection of the ground electrode to a relatively small value, the ground electrode is effectively prevented from inhibiting diffusion of the flame kernel. On the other hand, it was recognized that as shown in FIG. 10, the samples having a tip end distance of −0.4 mm or more exhibited a relatively large electrode wear amount even at the farthest edge, so that occurrence of localization in electrode wear without wear of the farthest edge can be suppressed. The reason therefor is considered to be that generation of the spark discharge between the tip end of the narrowed width portion and the farthest edge of the center electrode is promoted owing to such an arrangement that the tip end of the narrowed width portion was located near the farthest edge.

In general consideration of the above-described results of the respective evaluation tests, from the viewpoint of enhancing the ignition property of the spark plug, the value obtained by dividing the inner edge distance by the gap distance is preferably set to 1.25 or less, that is, the relation of $F \leqq 1.25G$ is preferably satisfied, the base end distance D is preferably set to 0 mm or more (more preferably 0.3 mm or more), or the tip end distance E is preferably set to +0.5 mm or less. Further, from the viewpoint of prolonging the life of the spark plug, the value (F−H) obtained by subtracting the outer edge distance from the inner edge distance is preferably set within the range of 0 mm to 0.3 mm or the tip end distance E is preferably set to −0.4 mm or more.

The present invention is not preferably limited to the above-described embodiment and may be modified as follows. Other modifications and variations which are not explained in the following can also be made.

Figure 11A:
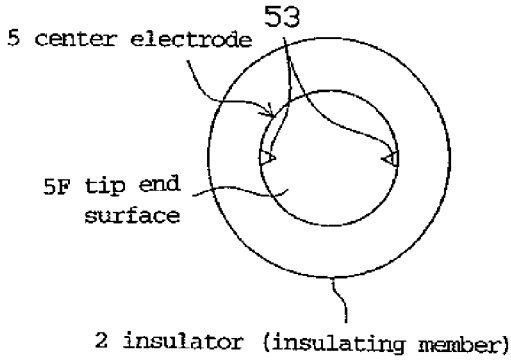
FIGS. 11(*a*) and 11(*b*) are partly enlarged plan views of center electrodes according to other embodiments, respectively.
Figure 11B:
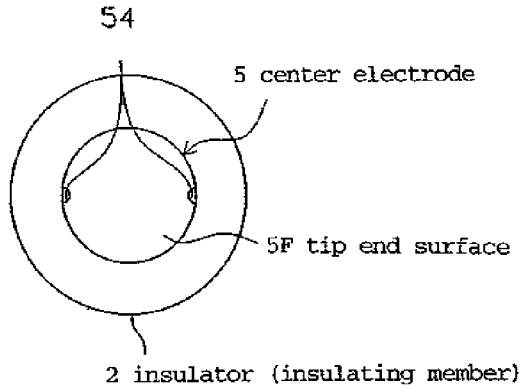
Figure 12A:
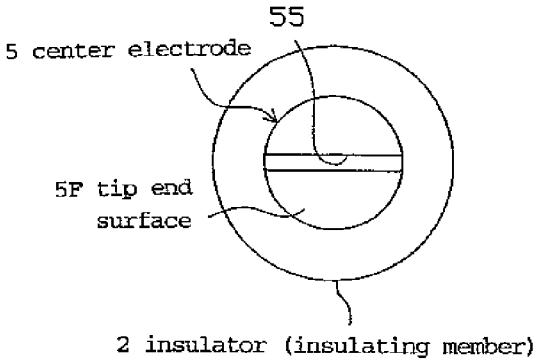
FIGS. 12(*a*) and 12(*b*) are partly enlarged plan views of center electrodes according to other embodiments, respectively.
Figure 12B:
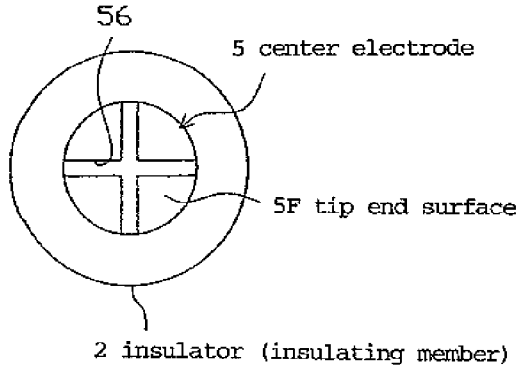

(a) In the above-described embodiment, the tip end surface 5F of the center electrode 5 is formed into a flat shape and spark discharge can be generated between the nearest edge NE or the farthest edge FE of the center electrode 5 and the ground electrode 27. However, diffusion of the flame generated between the nearest edge NE or the farthest edge FE and the ground electrode 27 tends to be slightly inhibited by the ground electrode 27. Therefore, to solve this problem, as shown in FIGS. 11(*a*), 11(*b*), cutout portions 53, 54 can be provided at the parts of the tip end surface 5F of the center electrode 5 which are located corresponding to the nearest edge NE and the farthest edge FE. Alternatively, as shown in FIGS. 12(*a*), 12(*b*), there can be provided grooved portions 55, 56 extending through the parts of the tip end surface 5F of the center electrode 5 which are located corresponding to the nearest edge NE and the farthest edge FE. With the provision of the cutout portions 53, 54 or grooved portions 55, 56, it is also possible to suppress occurrence of spark discharge at the parts at which diffusion of the flame tends to be inhibited by the ground electrode 27. In this case, flame diffusion property can be more effectively enhanced. Further, corners which are formed between the cutout portions 53, 54 or the grooved portions 55, 56 and the tip end surface 5F of the center electrode 5 can be subjected to chamfering or the corners can be formed into a curved shape. In this case, it is possible to suppress occurrence of spark discharge between the corners and the ground electrode 27 and thereby further enhance the flame diffusion property.

Figure 13:
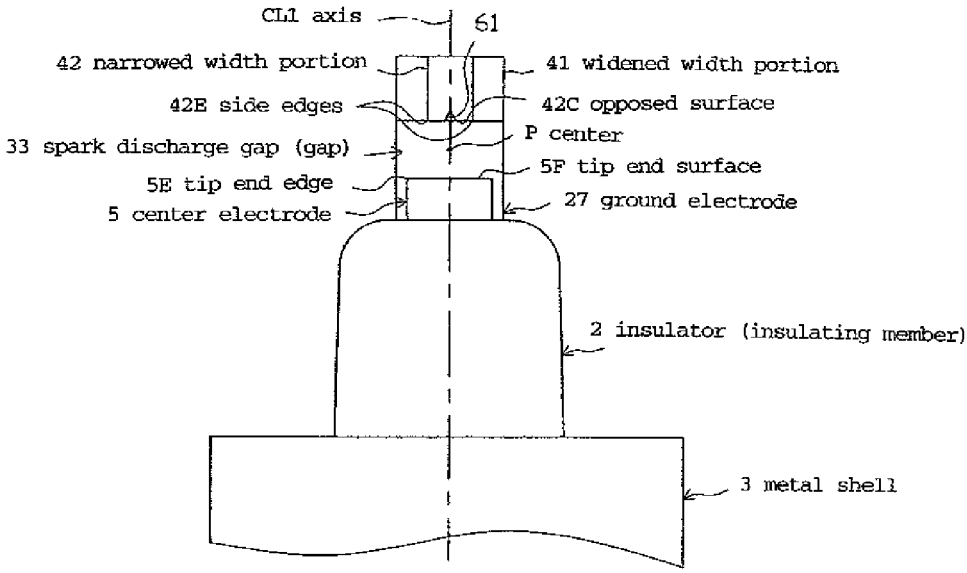
FIG. 13 is a partly enlarged side view of a ground electrode according to another embodiment.

(b) In the above-described embodiment, the surface 42C of the narrowed width portion 42 which is opposed to the tip end surface 5F of the center electrode 5 is formed into a flat shape. However, the opposed surface 42C can be provided with a grooved portion 61 which extends along the center axis CL2 of the narrowed width portion 42 as shown in FIG. 13. In this case, it is possible to suppress occurrence of spark discharge between the center electrode 5 and a middle portion of the narrowed width portion 42, that is, occurrence of spark discharge at the part where diffusion of the flame tends to be inhibited by the ground electrode 27, and thereby further enhance the ignition property. Further, corners which are formed between the opposed surface 42C of the narrowed width portion 42 and the grooved portion 61 can be subjected to chamfering or the corners can be formed into a curved shape as described in the above (a).

Figure 14A:
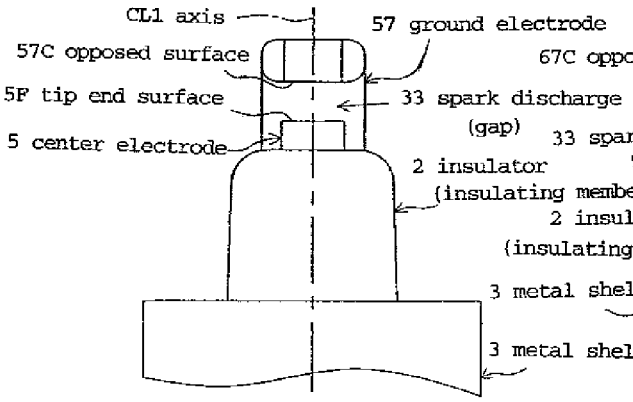
FIGS. 14(*a*) and 14(*b*) are partly enlarged side views of ground electrodes according to other embodiments, respectively.
Figure 14B:
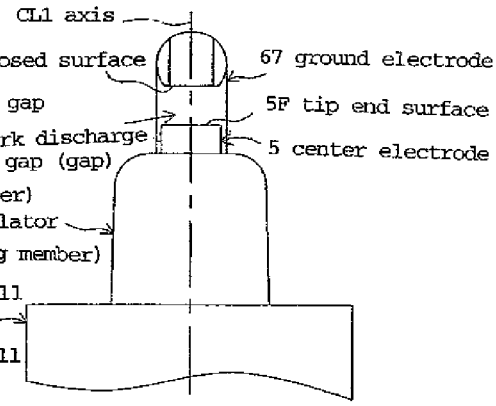

(c) In the above-described embodiment, the ground electrode 27 is formed into a rectangular shape in section. However, there can be provided a ground electrode 57 which is configured such that side surfaces adjacent to a surface 57C of the ground electrode 57 which is opposed to the tip end surface 5F of the center electrode 5 are formed into a curved shape swelling outwardly, that is, a semicircular shape in section, as shown in FIG. 14(*a*). Alternatively, there can be provided a ground electrode 67 which is configured such that at least a back surface of the surface 67C opposed to the tip end surface 5F of the center electrode 5 is formed into a curved shape swelling outwardly. In these cases, even when an air-fuel mixture is supplied from the back surface side of the ground electrode 57, 67, the air-fuel mixture can be allowed to flow into the spark discharge gap 33 so that the ignition property can be further enhanced.

(d) In the above-described embodiment, the spark discharge gap 33 is formed between the tip end surface 5F of the center electrode 5 and the ground electrode 27 (the narrowed width portion 42). However, a noble metal chip made of a Pt alloy or an Ir alloy can be provided at the tip end of the center electrode 5 such that the spark discharge gap 33 can be formed between the noble metal chip and the ground electrode 27 (the narrowed width portion 42). In this case, the durability of the spark plug can be further enhanced.

(e) In the above-described embodiment, the ground electrode 27 has a double layer structure constituted of the outer layer 27A and the inner layer 27B. However, the structure of the ground electrode 27 is not limited to the above-described embodiment. For instance, the ground electrode 27 can be constructed without the inner layer 27B or can have a three layer structure or a multiple layer structure including four layers or more.

(f) In the above-described embodiment, the ground electrode 27 is connected to the tip end surface of the tip end portion 26 of the metal shell 3. However, the ground electrode can be formed by cutting a part of the metal shell (or a part of a tip end metal shell previously welded to the metal shell) (for instance, Japanese Patent Application Unexamined Publication No. 2006-236906). Further, the ground electrode 27 can be connected to a side surface of the tip end portion 26 of the metal shell 3.

(g) In the above-described embodiment, the tool engagement portion 19 has a hexagonal shape in section. However, the shape of the tool engagement portion 19 is not limited to the hexagonal shape. For instance, the tool engagement portion 19 can be formed into a Bi-HEX shape [a deformed dodecagon) (ISO22977: 2005(E)] or the like.

| REFERENCE SIGNS LIST | |
|---|---|
| 1 | spark plug (spark plug for internal combustion engine) |
| 2 | insulator (insulating member) |
| 3 | metal shell |
| 4 | axial hole |
| 5 | center electrode |
| 5E | tip end edge |
| 5F | tip end surface (of center electrode) |
| 27 | ground electrode |
| 33 | spark discharge gap (gap) |
| 41 | widened width portion |
| 42 | narrowed width portion |
| 42B | base end of narrowed width portion |
| 42C | opposed surface |
| 42E | side edge |
| 51E | inner edge |
| 52E | outer edge |
| 57 | ground electrode |
| 57C | opposed surface |
| 67 | ground electrode |
| 67C | opposed surface |
| CL1 | axis |
| CL1 | center axis of narrowed width portion |
| FE | farthest edge |
| NE | nearest edge |

The invention claimed is:

1. A spark plug for an internal combustion engine, comprising:

a rod-shaped center electrode that extends in an axial direction of the spark plug;

a tubular insulator having an axial hole that extends in said axial direction of the spark plug in which said center electrode is received;

a tubular metal shell disposed along an outer circumference of said insulator; and a ground electrode which extends from a tip end portion of said metal shell and is disposed in such a bent state that a tip end portion thereof is opposed to said center electrode;

wherein a tip end portion of said center electrode and the tip end portion of said ground electrode cooperate to define a gap therebetween in which spark discharge is provided along said axial direction of the spark plug, wherein said ground electrode is formed with a narrowed width portion at the tip end portion thereof which has a substantially uniform width smaller than an outer diameter of a tip end surface of said center electrode, and a widened width portion which extends between a base end portion of said ground electrode and said narrowed width portion and has a width larger than the width of said narrowed width portion, wherein said narrowed width portion has a base end that is located offset from the tip end surface of said center electrode toward a root side of said ground electrode when viewed from a tip end side of the spark plug in said axial direction of the spark plug, and wherein said base end of the narrowed width portion is located offset from a center of said gap toward the tip end side of the spark plug in said axial direction of the spark plug.

2. The spark plug as claimed in claim 1, wherein said narrowed width portion comprises side edges formed between a surface opposed to said center electrode and side surfaces disposed adjacent to the opposed surface, and said center electrode comprises inner edges each being a part of a tip end edge formed between the tip end surface of said center electrode and an outer circumferential surface of said center electrode, said inner edges each being disposed between said side edges of said narrowed width portion when viewed from the tip end side of the spark plug in said axial direction of the spark plug, wherein a maximum distance F extending between said side edges of said narrowed width portion and said inner edges of said center electrode along a direction perpendicular to a center axis of said narrowed width portion and a distance G of said gap extending along said axial direction of the spark plug satisfy a relation expressed by the formula:

$$F \leqq 1.25G.$$

3. The spark plug as claimed in claim 1, wherein said narrowed width portion comprises side edges formed between a surface opposed to said center electrode and side surfaces disposed adjacent to the opposed surface, and said center electrode comprises inner edges each being a part of a tip end edge formed between the tip end surface of said center electrode and an outer circumferential surface of said center electrode, said inner edges each being disposed between said side edges of said narrowed width portion when viewed from the tip end side of the spark plug in said axial direction of the spark plug, and outer edges which are remainders of said tip end edge except for said inner edges, wherein a maximum distance F extending between said side edges of said narrowed width portion and said inner edges of said center electrode along a direction perpendicular to a center axis of said narrowed width portion and a maximum distance H extending between said side edges of said narrowed width portion and said outer edges of said center electrode along a direction perpendicular to the center axis of said narrowed width portion satisfy a relation expressed by the formula:

$$0\ \text{mm} \leqq F-H \leqq 0.3\ \text{mm}.$$

4. The spark plug as claimed in claim 1, wherein a distance D extending between a part of the tip end surface of said center electrode which is disposed closest to the root of said ground electrode and the base end of said narrowed width portion along the center axis of the narrowed width portion satisfies the formula:

$$D \geqq 0.3\ \text{mm}.$$

5. The spark plug as claimed in claim 1, wherein assuming that a direction extending to be close to the root side of said ground electrode is expressed by a minus "−" direction and a direction extending to be away from the root side of said ground electrode is expressed by a plus "+" direction, when being viewed from the tip end side of the spark plug in said axial direction of the spark plug and using a part of the tip end surface of said center electrode which is disposed most distant from the root of said ground electrode, as a reference, a distance E extending between the part of the tip end surface of said center electrode which is disposed most distant from the root of said ground electrode and a tip end of said narrowed width portion along the center axis of said narrowed width portion satisfies the formula:

$$-0.4\ \text{mm} \leqq E \leqq +0.5\ \text{mm}.$$

* * * * *